US008104104B2

(12) United States Patent
Le et al.

(10) Patent No.: US 8,104,104 B2
(45) Date of Patent: Jan. 31, 2012

(54) DUAL FLUSH BUTTON ASSEMBLY

(75) Inventors: Tuan Le, Diamond Bar, CA (US); Bryan Janish, Carlsbad, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 551 days.

(21) Appl. No.: 12/286,602

(22) Filed: Oct. 1, 2008

(65) Prior Publication Data

US 2009/0089922 A1 Apr. 9, 2009

Related U.S. Application Data

(60) Provisional application No. 60/997,416, filed on Oct. 3, 2007.

(51) Int. Cl.
*E03D 5/09* (2006.01)

(52) U.S. Cl. ..... 4/410; 4/325

(58) Field of Classification Search ..... 4/324–327, 4/405, 407, 410, 415; 200/5 A, 314, 329, 200/341

See application file for complete search history.

(56) References Cited

U.S. PATENT DOCUMENTS

| | | | | |
|---|---|---|---|---|
| 5,283,407 | A * | 2/1994 | Pohl | 200/332 |
| 5,659,903 | A * | 8/1997 | Hammarstedt | 4/325 |
| 5,933,879 | A | 8/1999 | Wooldridge et al. | |
| 6,163,897 | A * | 12/2000 | Plas et al. | 4/410 |
| 6,703,571 | B2 * | 3/2004 | Nishimoto et al. | 200/6 A |
| 6,785,913 | B2 | 9/2004 | Ho | |
| 6,920,649 | B2 * | 7/2005 | Oury | 4/325 |
| 2008/0189842 | A1 * | 8/2008 | Spogardh | 4/224 |

OTHER PUBLICATIONS

The definition of the term "linear" is included in Office Action and was downloaded from http://www.thefreedictionary.com/linear.*
PCT International Search Report, Dec. 1, 2008.

* cited by examiner

*Primary Examiner* — Brian Glessner
*Assistant Examiner* — Brian D Mattei
(74) *Attorney, Agent, or Firm* — Gordon & Rees LLP

(57) ABSTRACT

A dual flush button assembly includes a unitary button with a full flush surface and a partial flush surface. Pressing the partial flush surface moves the button linearly to active a partial flush. Pressing the full flush surface rotates the button to activate a full flush. An extension member beneath the button is coupled to a link of a dual flush valve. The extension member is moved farther when the full flush surface is engaged. The button is configured to pivot with respect to a housing when the full flush portion is engaged.

9 Claims, 8 Drawing Sheets

DUAL FLUSH BUTTON ASSEMBLY

RELATED APPLICATIONS

This application relates to, claims priority from, and incorporates herein by reference, as if fully set forth, U.S. Provisional Patent Application Ser. No. 60/997,416 filed on Oct. 3, 2007 and entitled "TOGGLE AND PUSH BUTTONS FOR DUAL FLUSH VALVE."

BACKGROUND OF THE INVENTION

1. Field of the Invention

The present invention relates generally to dual flush systems for toilets and particularly to a button assembly for dual flush systems.

2. Description of Prior Art and Related Information

Demand for dual flush toilets continues to grow as water conversation becomes an ever increasing concern. Dual flush toilets conserve water by providing the user with options for a partial flush and full flush for liquid and solid wastes, respectively. Conventional dual flush toilets include two separate buttons for a user to activate the desired flush. The buttons are typically separated by a gap which can create a hazard for the user's fingernails. Larger housing is typically required to hold multiple buttons.

SUMMARY OF THE INVENTION

The present invention provides structures and methods which overcome the deficiencies in the prior art.

In one aspect, a dual flush button assembly is provided. The assembly comprises a partial flush button portion and a full flush button portion. The partial flush button portion is configured to move a structural member a first distance in response to a first activation. The full flush button portion configured to move the structural member a second distance greater than the first distance in response to a second activation, the full flush button portion being configured to pivot so as to move the structural member.

The partial flush button portion comprises a first top button surface. The full flush button portion comprises a second top button surface that is integral with the first top button surface. The structural member is configured move downwardly to a first location in response to engagement of the partial flush button portion. The structural member is configured move downwardly to a second location positioned beneath the first location.

The assembly further comprises a housing having a slot. At least one pivot rod is slidingly disposed in the slot and configured to facilitate rotation of the partial flush button portion and the full flush button portion when the full flush button portion is engaged.

In another aspect, a dual flush button assembly is provided having a first button portion configured to active a partial flush when engaged, and a second button portion integral with the first button surface and being configured to activate a full flush when engaged. A structural member is disposed inwardly of and beneath the first and second button portions. The first button portion is configured to move in a linear direction when engaged. The second button portion is configured to rotate when engaged.

A spring mechanism biases the second button portion in order to facilitate a pivot when the second button surface is engaged. An extension member is disposed opposite to the first and second button surfaces, and configured to move axially in response to the engagement of the first button surface or the second button surface. The extension member is coupled to a link of a dual flush valve.

In a further aspect, a dual flush button assembly comprises a housing and a button having a partial flush top surface and a full flush top surface. The button is configured to pivot with respect to the housing when the full flush top surface is engaged. The button is configured to move a structural member to a first position when the partial flush top surface is engaged, and configured to move the structural member to a second position farther than the first position when the full flush top surface is engaged. The button is configured to move linearly into the housing to the first position when the partial flush top surface is engaged, and configured to pivot when the full flush top surface is engaged.

In a further aspect, a method for manufacturing a dual flush toilet is provided. The method comprises forming a button with a partial flush button portion and a full flush button portion, coupling the button to a dual flush valve, configuring the button to activate a partial flush when the partial flush button portion is engaged, and configuring the button to activate a full flush when the full flush button portion is engaged.

The step of configuring the button to activate the partial flush when the partial flush button portion is engaged comprises moving the partial flush button portion in a linear direction. The step of configuring the button to activate the full flush when the full flush button portion is engaged comprises rotating the full flush button portion when the full flush button portion is engaged. The step of configuring the button to activate the partial flush when the partial flush button portion is engaged comprises moving a structural member beneath the button a first axial distance. The step of configuring the button to activate the full flush when the full flush button portion is engaged comprises moving the structural member beneath the button a second axial distance greater than the first axial distance.

In summary, a dual flush button assembly includes a unitary button with a full flush surface and a partial flush surface. Pressing the partial flush surface moves the button linearly to active a partial flush. Pressing the full flush surface rotates the button to activate a full flush. An extension member beneath the button is coupled to a link of a dual flush valve. The extension member is moved farther when the full flush surface is engaged. The button is configured to pivot with respect to a housing when the full flush portion is engaged.

The invention, now having been briefly summarized, may be better appreciated by the following detailed description.

DETAILED DESCRIPTION OF THE PREFERRED EMBODIMENTS

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

Figure 1:
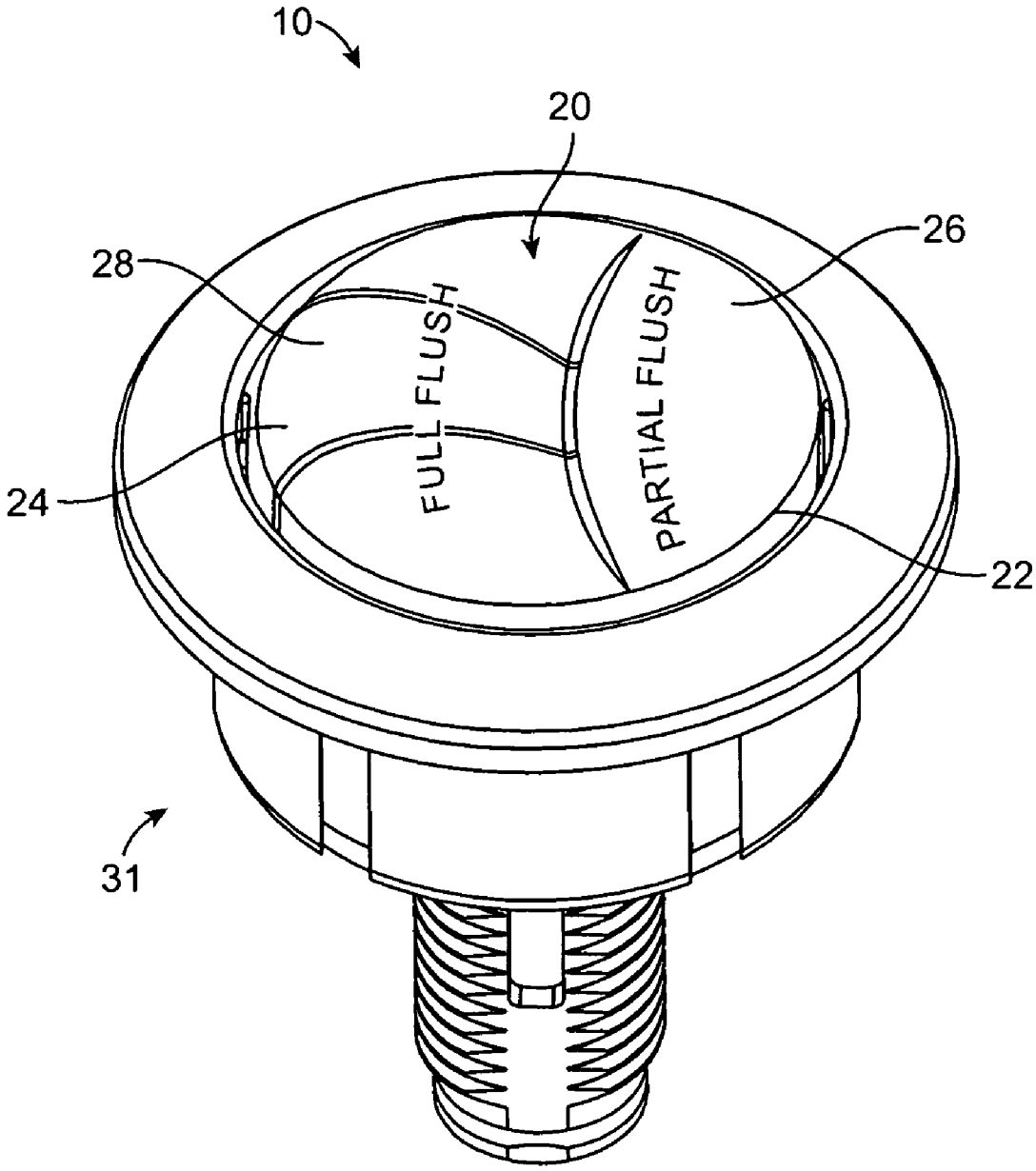
FIG. 1 is a perspective view of a first preferred embodiment of a dual flush button assembly.

In FIG. 1, a preferred embodiment of a dual flush button assembly is illustrated and designated generally by the reference numeral 10. The assembly 10 includes a unitary, one-piece button 20 having a first portion 22 and a second portion 24, which portions 22, 24 are integral such that no gap exists between them. The first partial flush portion 22 is operatively configured to activate a partial flush when engaged, while the second full flush portion 24 is operatively configured to activate a full flush when engaged. Thus, the first portion 22 includes a first, partial flush top surface 26 that is preferably smaller in surface area and shorter in height than a second full flush top surface 28. The preferably larger and taller full flush outer surface 28 is integral with the partial flush outer surface 26. Indicia, such as wording, colors, logos or graphics, may be placed on the outer button surfaces 26, 28 and used to distinguish one surface 26 from the other 28. The assembly 10 includes a housing 31.

Figure 2:
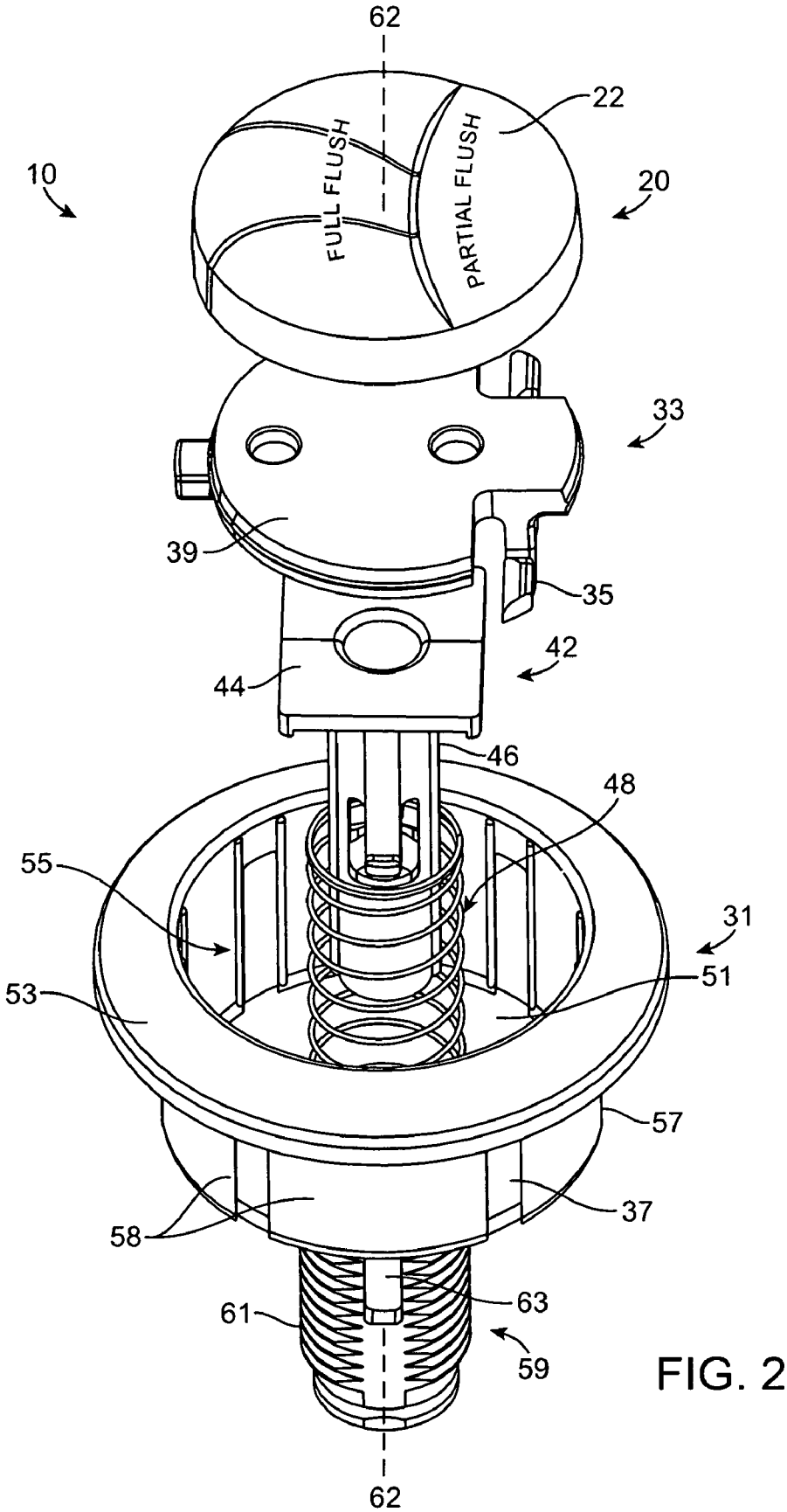
FIG. 2 is an exploded view of the first preferred embodiment of the dual flush button assembly.

FIG. 2 is an exploded view of the preferred embodiment of the button assembly 10. The assembly 10 preferably includes a pivot member 33 disposed beneath, or inwardly of, the button 20. Though the pivot member 33 is shown separate from the button 20 in the preferred embodiment, it is to be understood that the pivot member 33 may be formed integrally with the button 20 to form a unitary piece. The pivot member 33 includes a pair of pivot rods 35 configured to be disposed in a corresponding pair of axial slots 37 formed in the housing 31. The pivot rods 35 are preferably configured to pivot and slide axially within the slots 35.

In the preferred embodiment, the pivot member 33 includes a plate body 39 positioned to abut a bottom, or inner, surface of the button 20. The pivot member 33 is disposed between the button 20 and an extension member, or structural member, 42. The extension member 42 may also comprise a link coupled to other links and gears of a dual flush valve which ultimately controls the fluid communication between the toilet tank and the toilet bowl. The extension member 42 includes an upper plate 44 in abutting relationship with a bottom of the pivot member 33, and an elongate shaft or rod 46 extending perpendicularly to and away from the pivot member 33. A spring mechanism 48, shown in the preferred embodiment as a coil spring 48 surrounding the shaft 46, rests on a floor 51 of the housing 31 and biases the link 42, and ultimately the pivot member 33 and button 20, upwardly and outwardly away from the housing floor 51 to an upper, outward rest position, as shown in FIGS. 1 and 3.

In the preferred embodiment, the housing 31 includes an upper flange 53, substantially annular and configured to rest on top of, for example, a toilet tank lid (not shown). The housing 31 defines a compartment 55 preferably sized large enough to receive the button 20, pivot member 33 and spring mechanism 48. The housing compartment 55 is further defined by a curved wall 57 having wall portions 58 which are preferably spaced apart to form the axial slots, or tracks, 37 which receive the pair of opposing pivot rods 35. For ease of manufacturing, the housing 31 is preferably formed as a unitary structure where the flange 53, wall 57 and floor 51 are integral with one another, and the slots 37 are formed as openings in the wall 57. The housing 31 includes a downwardly, or inwardly, extending tube 59 with external threads 61. The tube 59 and defines an axis 62 and an axial passage 63 through which the shaft 46 may travel.

Figure 3:
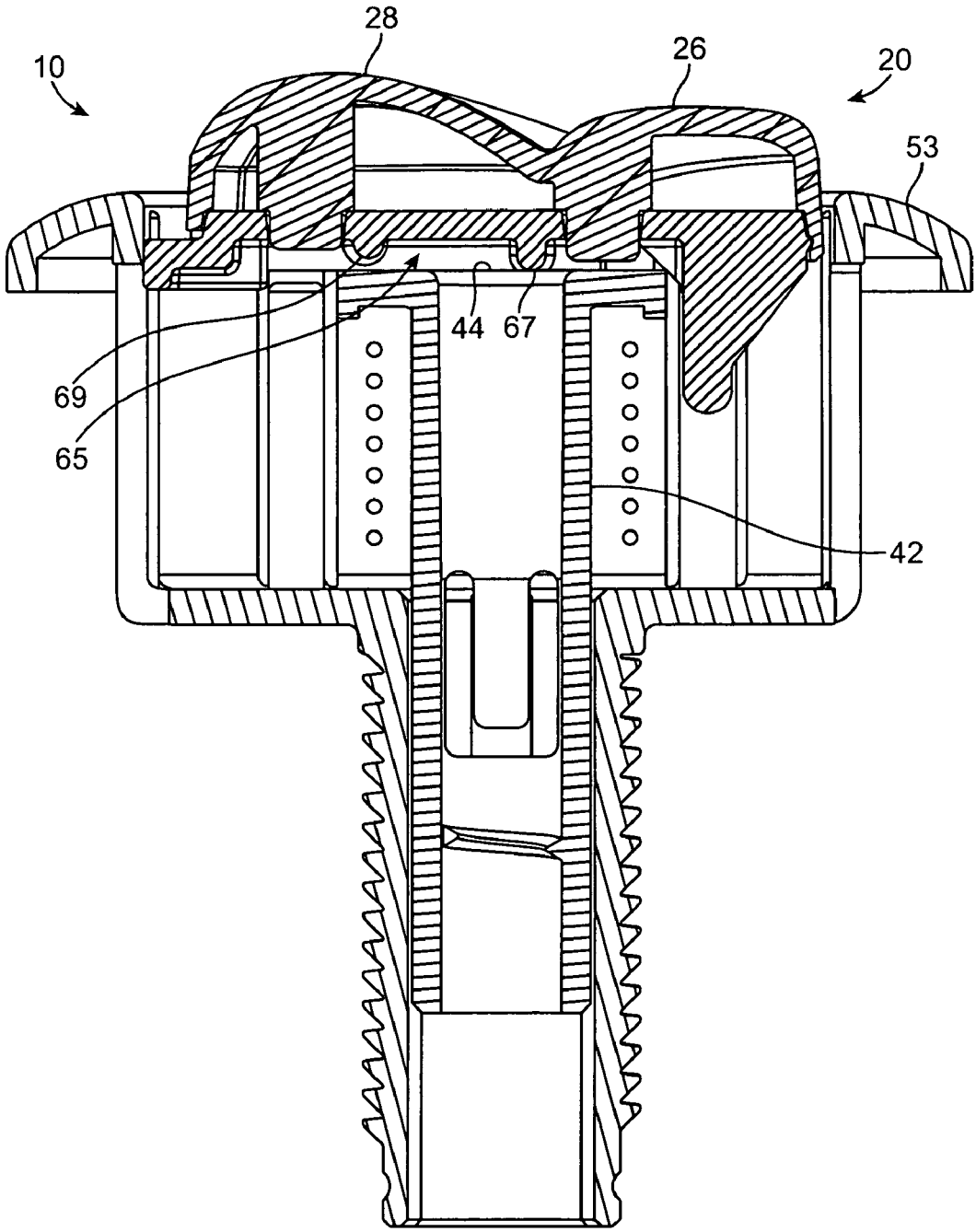
FIG. 3 is a cross-sectional view of the first preferred button assembly at rest state.

FIG. 3 is a cross-sectional view of the preferred assembly 10 in a rest, default state, namely, when the toilet is not being flushed. In the rest state, the button 20 is preferably positioned at or adjacent to the top housing flange 53 such that the top button surfaces 26, 28 preferably protrude slightly above and outwardly from the housing 31. A plate bottom 65 of the pivot member 33 includes a first partial flush rib, or protrusion, 67 and a second full flush rib, or protrusion, 69. The partial flush rib 67 extends deeper than the full flush rib 69 so as to make initial contact with the plate 44 of the extension member 42 when the partial flush button surface 26 is engaged.

Figure 4:
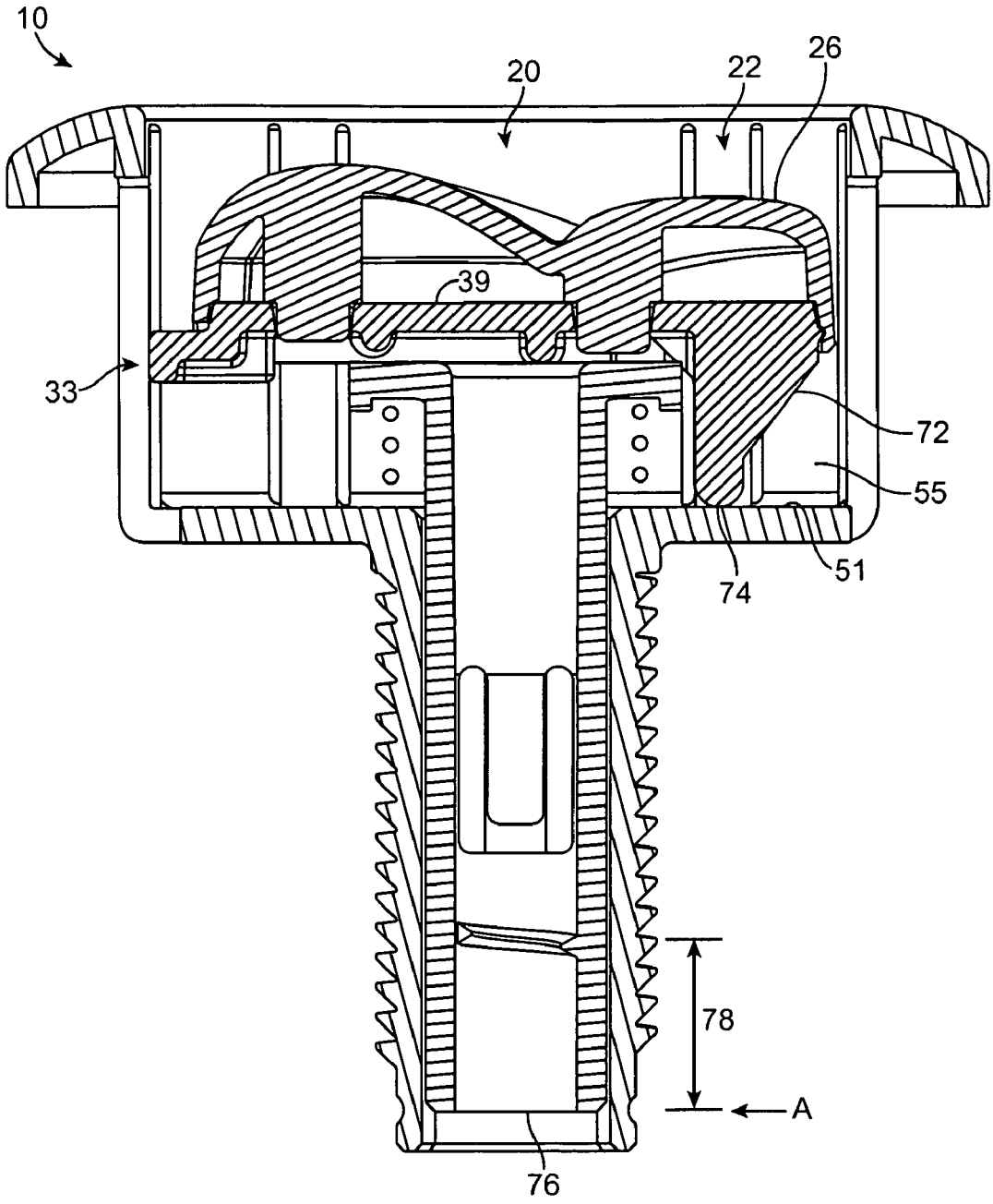
FIG. 4 is a cross-sectional operative view of the first preferred button assembly when a partial flush is activated.

FIG. 4 is a cross-sectional operative view of the preferred assembly 10 when the partial flush portion 22 is engaged (e.g., pressed down). In particular, a partial flush is activated when a user presses the partial flush button surface 26. By locating the partial flush button portion 22 adjacent to and on top of the pivot rods 35 which serve as the hinge of the pivot member 33, as shown in FIG. 2, pressing the partial flush button surface 26 downwardly and into the housing compartment 55 causes both the button 20 and the adjacent pivot member 33 to travel downwardly in a linear manner as shown in FIG. 4. The pivot member 33 includes an inner perpendicular portion 72 that extends perpendicularly to the plate body 39 and includes a bottom end 74 that serves to stop the downward, inward movement of both the pivot member 33 and the button 20 when the end 74 abuts the housing floor 51. At this lowermost point of the partial flush activation, the bottom end 76 of the shaft 46 of the extension member 42 has traveled a first, shorter axial distance 78 to a first position A.

Figure 5:
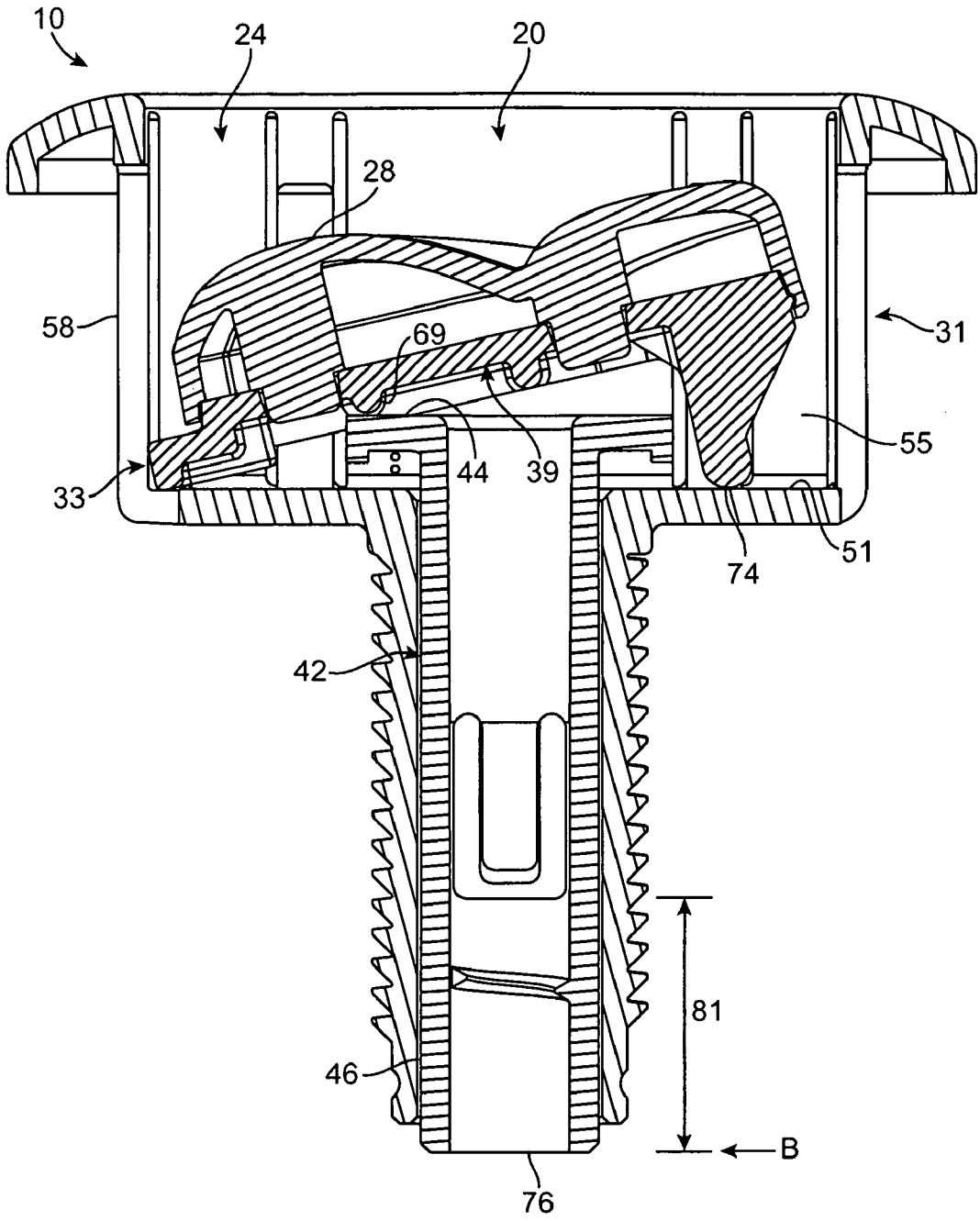
FIG. 5 is a cross-sectional operative view of the first preferred button assembly when a full flush is activated.

FIG. 5 is a cross-sectional operative view of the preferred assembly 10 when the full flush portion 24 is engaged. In particular, a full flush is activated when a user presses the full flush button surface 28. By locating the full flush button portion 24 away from, and not directly above, the pivot rods 35 (shown in FIG. 2) and the hinge of the pivot member 33, pressing the full flush button surface 28 downwardly and into the housing compartment 55 causes both the button 20 and the adjacent pivot member 33 to travel downwardly. When the bottom end 74 of the perpendicular portion 72 contacts the housing floor 51, the end 74 serves as fulcrum. The plate body 39 of the pivot member 33 acts as a lever while both the button 20 and the pivot member 33 rotate downwardly and inwardly (shown in FIG. 5 as a counterclockwise rotation). As the pivot member 33 rotates, the full flush rib 69 contacts the upper plate 44 and causes the extension member 42 to travel downwardly and inwardly. At this lowermost point of the full flush activation, the bottom end 76 of the shaft 46 of the extension member 42 travels a second, farther axial distance 81 a second position B, which is axially farther and lower than the first position A shown in FIG. 4.

When the full flush button portion 24 is engaged, it will be appreciated that the upward bias of the spring 48 (depending upon the magnitude of this upward force) in conjunction with the pivot rods 35 disposed in the housing slots 37, shown in FIG. 2, may facilitate rotation of the button 20 prior to the pivot member end 74 contacting the housing floor 51. It will also be appreciated that sufficient space in the housing 31, particularly in the housing compartment 55, is provided to enable the button 20 to pivot. This may be accomplished in a variety of ways. In FIG. 5, one preferred embodiment to accomplish this is to space the housing wall portions 58 adjacent to the full flush button portion 24 sufficiently apart from the full flush button portion 24 to enable rotation.

When the partial flush button portion 22 is engaged, rotation is inhibited by a number of factors, including locating the partial flush button portion above the pivot rods 33 (shown in FIG. 2) and perpendicular end portion 74 (shown in FIG. 4), and locating the housing wall portions 58 in close proximity to the partial flush button portion 22 to minimize any space for rotation, as shown in FIG. 4.

The first preferred dual flush button assembly 10 may be configured to operate in connection with a variety of dual flush valves configured to switch between partial flush and full flush operations. For example, the preferred dual flush button assembly 10 may be coupled to any dual flush valve which can toggle between a full flush operation and a partial flush operation as a result of the differing lengths of axial movement of the extension member 42.

Figure 6:
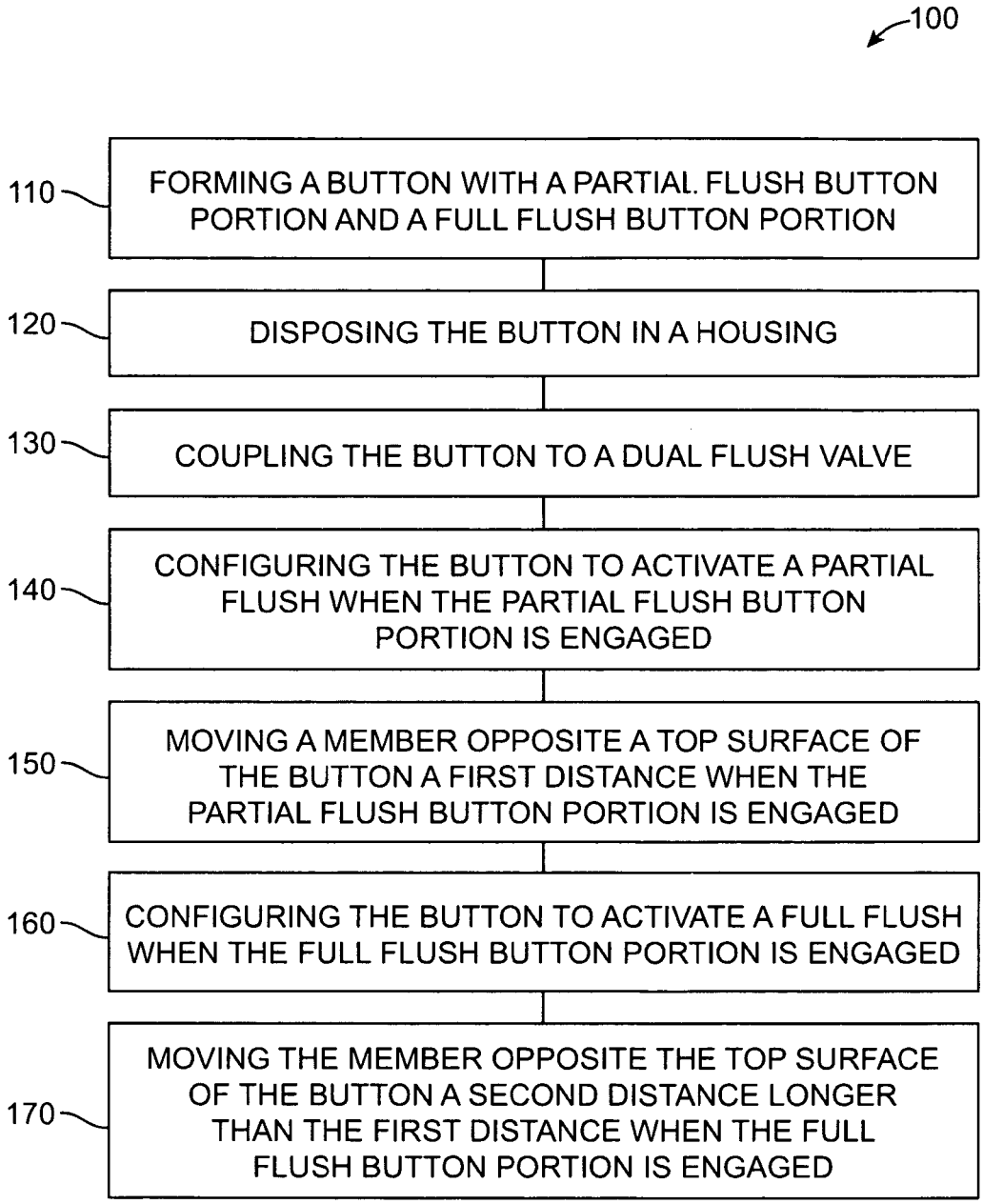
FIG. 6 is a block diagram of a preferred method of manufacturing a toilet assembly.

FIG. 6 is a block diagram of a preferred method 100 of manufacturing a dual flush button assembly. The method 100 comprises the step 110 of forming a button with a partial flush button portion and a full flush button portion, both portions which are integral to each other and part of a unitary, one-piece structure. In step 120, the button is disposed in a housing with a compartment sized large enough for the button to move in at least two different ways pursuant to the type of flush desired by the user. In step 130, the button is coupled to a dual flush valve. This may involve coupling the button to a number of intermediary structures, such as extension members, gears and links, in order to couple the button operatively to the dual flush valve.

In step 140, the button is configured to activate a partial flush when the partial flush button portion is engaged. In one embodiment, this may be accomplished in step 150 by causing the button to move a structural member beneath, or opposite the outer surface of, the button a first relatively short distance when the partial flush button portion is engaged. In one embodiment, this step comprises configuring the button to travel linearly when the partial flush portion is engaged.

In step 160, the button is configured to activate a full flush when the full flush button portion is engaged. In one embodiment, this may be accomplished in step 170 by causing the button to move a member located opposite the top button surface, e.g., beneath the button, a second distance longer than the first distance when the full flush button portion is engaged. In one embodiment, this step comprises configuring the button to pivot when the full flush portion is engaged.

Figure 7:
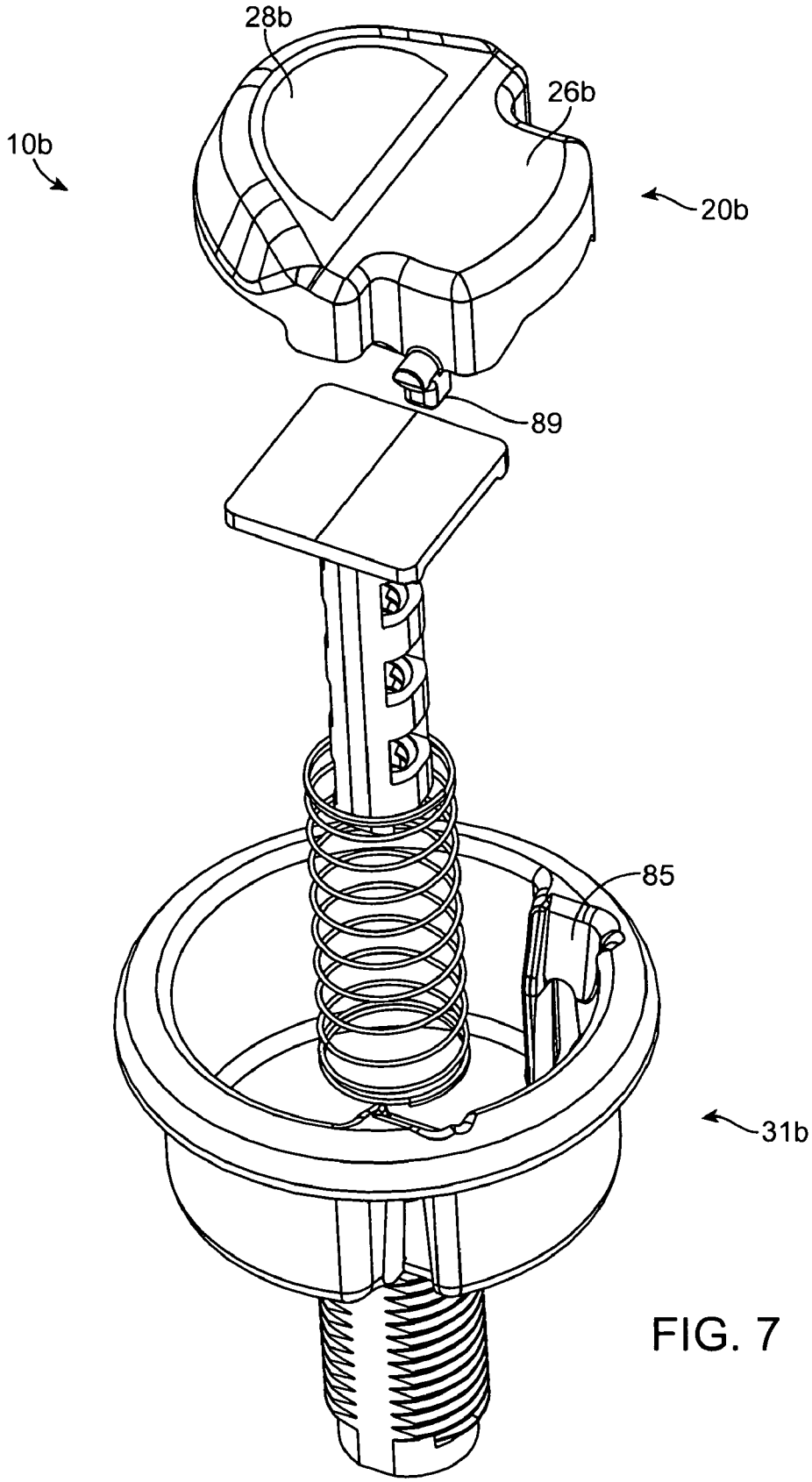
FIG. 7 is an exploded view of a second preferred embodiment of the dual flush button assembly.
Figure 8:
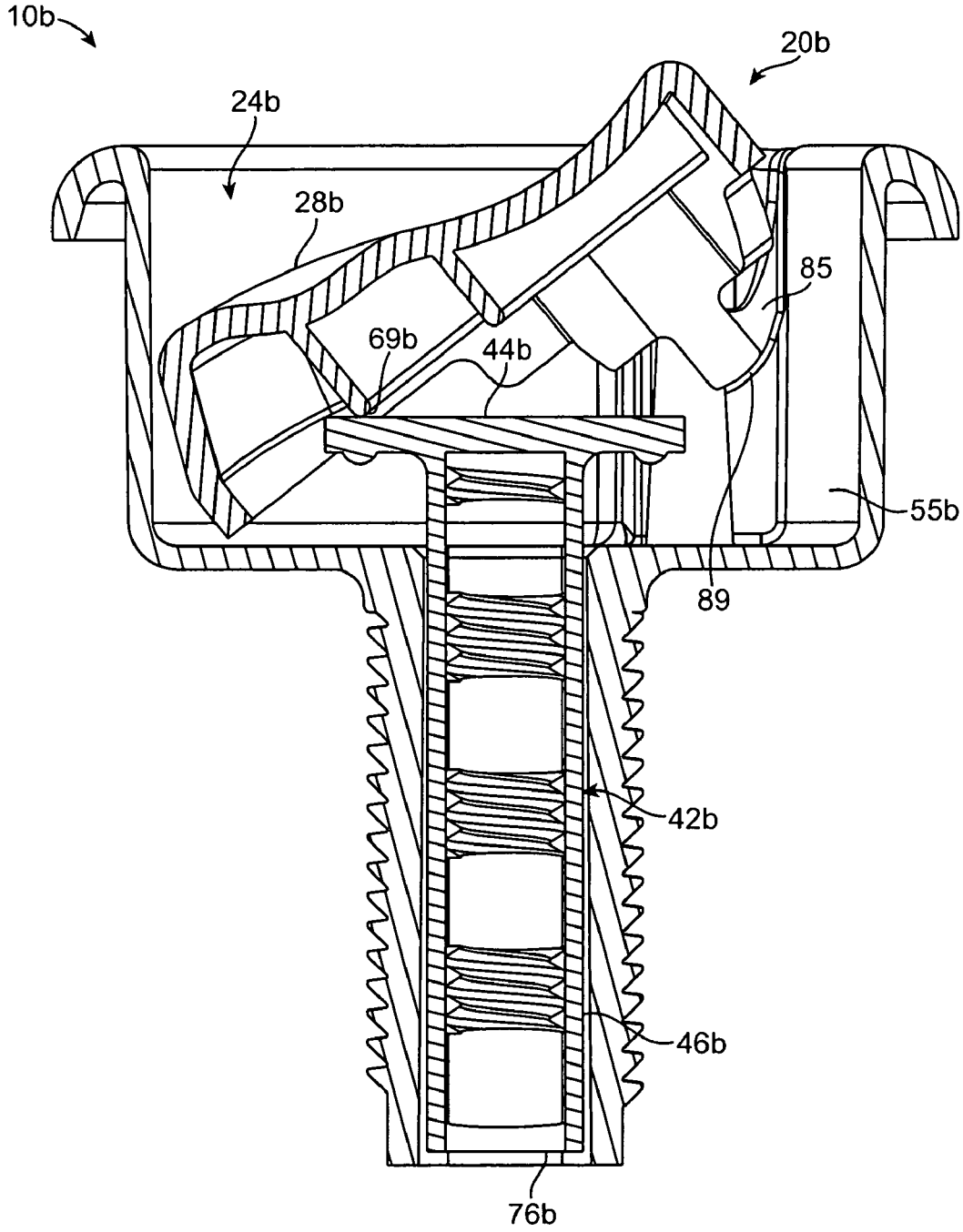
FIG. 8 is a cross-sectional operative view of the second preferred button assembly when a full flush is activated.

A variety of mechanisms may be employed to facilitate the rotation of the button, and thus farther travel of coupled members, when the full flush portion is engaged. FIGS. 7 and 8 illustrate a second preferred embodiment of dual flush a assembly 10*b*. In the illustrated embodiment, each of these sections has components which are similar to those in other sections. For simplicity, the reference numerals associated with these components will be the same, followed by the letter "b" which designates the associated section. When the similar components are referred to collectively, the letters will be omitted.

In FIG. 7, the housing 31*b* comprises an inner shoulder 85 formed along the inner wall 87 and spaced above the housing floor 51*b*. The shoulder 85 is positioned to abut a protrusion, or fulcrum, 89 extending from a bottom of the button 20*b*. In this second embodiment, a separate pivot member (shown as 33 in FIGS. 1-5) is omitted, as the structural features thereof may be formed integrally with the button 20*b* in accordance with the invention. A full flush button surface 28*b* may be more pronounced and raised with respect to the partial flush button surface 26*b* in order to make it more intuitive to a user as to which side of the button 20*b* to press for the desired flush.

FIG. 8 is a cross-sectional operative view of the preferred assembly 10*b* when the full flush portion 24*b* is engaged. In particular, a full flush is activated when a user presses the full flush button surface 28*b*. In this embodiment, pressing the full flush button surface 28*b* downwardly and into the housing compartment 55*b* causes the fulcrum 89 to abut the upper inner shoulder 85, thereby facilitating rotation (shown here as counterclockwise) as the full flush button surface 28*b* is further pressed. A full flush rib 69*b* contacts an upper plate 44*b* and causes an extension member 42*b* to travel downwardly. Similar to the first embodiment, the bottom end 76*b* of the shaft 46*b* of the extension member 42*b* travels a farther distance to a lower position than the position resulting from a non-pivoting, linear motion of the partial flush operation in the second embodiment 10*b*.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the invention.

What is claimed is:

1. A dual flush button assembly, comprising:

a flush button having a partial flush portion and a full flush portion;

the partial flush button portion configured to move a structural member a first distance in a first linear direction in response to a first activation; and the full flush button portion configured to move the structural member a second distance in the first linear direction greater than the first distance in the first linear direction in response to a second activation, the full flush button portion also being configured to pivot so as to move the structural member to the second distance;

wherein the flush button only moves in a linear direction and does not pivot when the partial flush button portion is pushed but wherein the flush button moves both in the linear direction and pivots when the full flush button portion is pushed.

2. The assembly of claim 1, wherein:

the partial flush button portion comprises a first top button surface;

the full flush button portion comprises a second top button surface; and the first top button surface is integral with the second top button surface.

3. The assembly of claim 2, wherein:

the structural member is configured move in the first direction to a first location in response to engagement of the partial flush button portion; and the structural member is configured move in the first direction to a second location in response to engagement of the full flush button portion.

4. The assembly of claim 1, further comprising:

a housing including a slot; and at least one pivot rod slidingly disposed in the slot and configured to facilitate rotation of the partial flush button portion and the full flush button portion when the full flush button portion is engaged.

5. The assembly of claim 1, further comprising a spring mechanism biasing the full flush button portion in order to facilitate a pivot when the second button surface is engaged.

6. A method for manufacturing a dual flush toilet, comprising:

forming a button with a partial flush button portion and a full flush button portion;

coupling the button to a dual flush valve;

configuring the button to activate a partial flush by moving a structural member a first distance when the partial flush button portion is engaged; and configuring the button to activate a full flush by moving the structural member a second distance which is greater than the first distance when the full flush button portion is engaged, wherein the button only moves in a linear direction and does not pivot when the partial flush button portion is pushed but wherein the button moves both in the linear direction and pivots when the full flush button portion is pushed.

7. The method of claim 6, wherein:

configuring the button to activate the partial flush when the partial flush button portion is engaged comprises moving the partial flush button portion in a linear direction.

8. The method of claim 6, wherein:

configuring the button to activate the full flush when the full flush button portion is engaged comprises rotating the full flush button portion when the full flush button portion is engaged.

9. The method of claim 6, wherein:

configuring the button to activate the partial flush when the partial flush button portion is engaged comprises moving a structural member beneath the button a first axial distance; and configuring the button to activate the full flush when the full flush button portion is engaged comprises moving the structural member beneath the button a second axial distance greater than the first axial distance.

* * * * *